US008240841B2

(12) United States Patent
Caracciolo et al.

(10) Patent No.: US 8,240,841 B2
(45) Date of Patent: Aug. 14, 2012

(54) PULSE DRYING SYSTEM

(76) Inventors: David M Caracciolo, Cortland, IL (US); Dion Thompson, Joliet, IL (US)

( * ) Notice: Subject to any disclaimer, the term of this patent is extended or adjusted under 35 U.S.C. 154(b) by 374 days.

(21) Appl. No.: 12/543,874

(22) Filed: Aug. 19, 2009

(65) Prior Publication Data

US 2010/0171803 A1 Jul. 8, 2010

Related U.S. Application Data

(60) Provisional application No. 61/142,345, filed on Jan. 3, 2009.

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS

| | | | | |
|---|---|---|---|---|
| 4,058,739 | A * | 11/1977 | Bjorkholm et al. | 359/326 |
| 5,115,741 | A | 5/1992 | Rodi | |
| 6,675,494 | B1 | 1/2004 | Oechsle | |
| 6,857,368 | B2 | 2/2005 | Pitz | |
| 6,877,247 | B1 | 4/2005 | DeMoore | |
| 6,889,608 | B2 | 5/2005 | Pitz | |
| 7,425,296 | B2 | 9/2008 | Cochran | |
| 2003/0194524 | A1 * | 10/2003 | Kwasny et al. | 428/40.1 |
| 2005/0190247 | A1 | 9/2005 | Unter | |
| 2005/0235851 | A1 | 10/2005 | Beier | |
| 2006/0290760 | A1 * | 12/2006 | German et al. | 347/102 |

FOREIGN PATENT DOCUMENTS

| | | | |
|---|---|---|---|
| JP | 59133058 | A | 7/1984 |
| JP | 7144403 | A | 6/1995 |

* cited by examiner

*Primary Examiner* — Stephen Meier
*Assistant Examiner* — Tracey McMillion
(74) *Attorney, Agent, or Firm* — Clark Hill PLC

(57) ABSTRACT

A laser drying system for printing is described. The present invention comprises in one embodiment a printer configured to apply liquid ink to a portion of a substrate to produce a printed area and a non-printed area, a laser module comprising a laser emitting a laser emission, the laser module mounted on an adjustable mount, a means to move the substrate from the printer to the laser module, the mount located over the means to move, an optic module comprising a focusing lens to focus the laser emission, and a controller configured to obtain print data from the printer and to operate the mount, the laser module, and the optic module to focus the laser emission only at the printed area of the substrate and not at the non-printed area of the substrate.

5 Claims, 1 Drawing Sheet

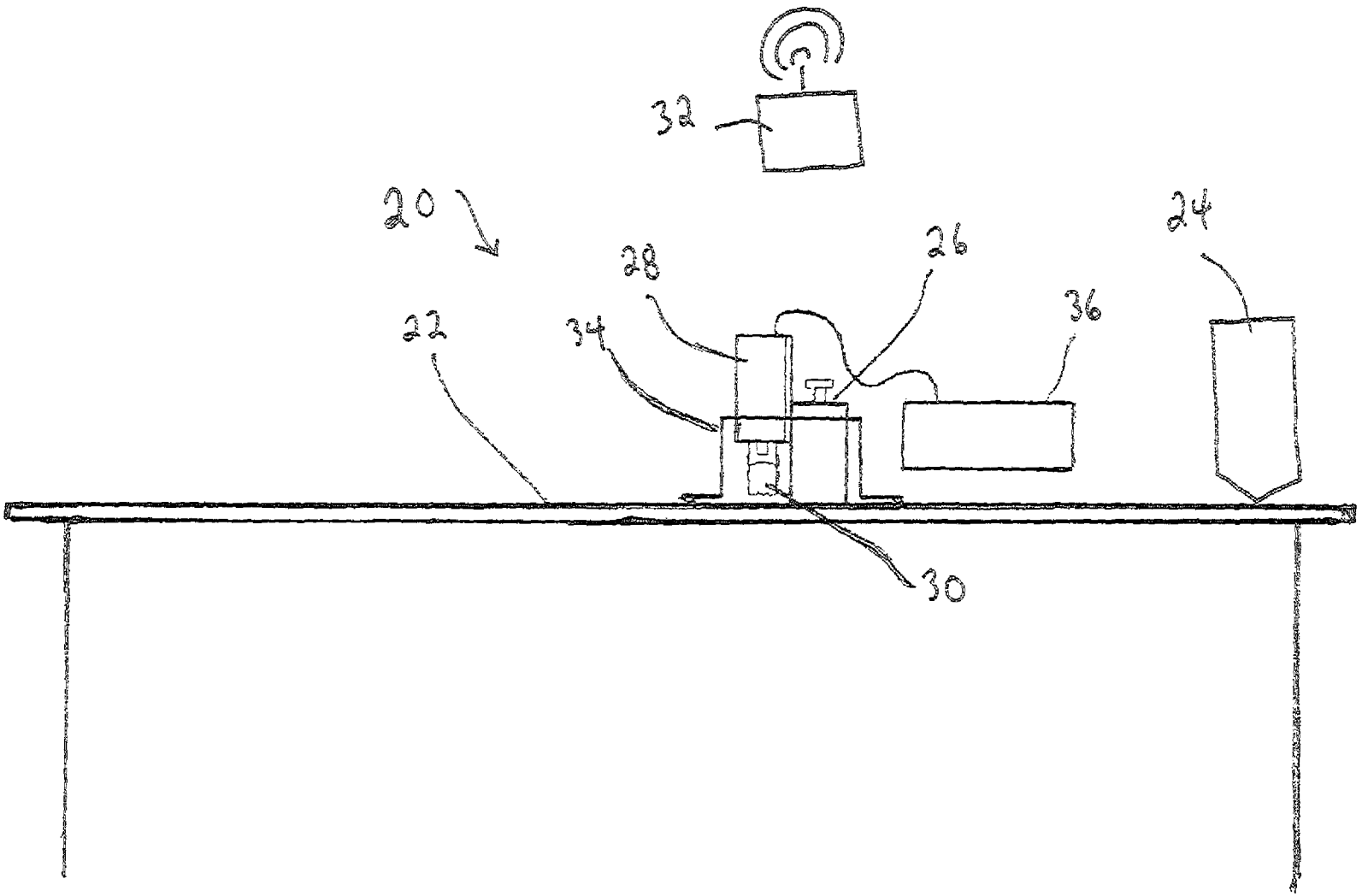
20
22
24
26
28
30
32
34
36

PULSE DRYING SYSTEM

CROSS-REFERENCE TO RELATED APPLICATIONS

This application claims priority from U.S. Provisional Application No. 61/142,345, filed on Jan. 3, 2009, the disclosure of which is incorporated herein.

BACKGROUND OF THE INVENTION

The present invention relates to the field of printing. There are two general classes of printing, "cold" or "non-heat-set" printing, and "heat-set" printing. In either case, ink is applied to a substrate such as paper or paperboard. In cold printing, the ink applied to the substrate is air dried. The ink absorbs into the substrate. Heat-set printing uses drying lamps or heaters to cure or set the ink. Some inks are energy-cured and require ultraviolet lamps or electron beam devices to cure the ink.

Conventional dryers require power high power consumption and space. The present invention addresses some of the inadequacies of the prior art.

BRIEF SUMMARY OF THE INVENTION

Briefly, and in accordance with the foregoing, the present invention comprises in one embodiment a printer configured to apply liquid ink to a portion of a substrate to produce a printed area and a non-printed area, a laser module comprising a laser emitting a laser emission, the laser module mounted on an adjustable mount, a means to move the substrate from the printer to the laser module, the mount located over the means to move, an optic module comprising a focusing lens to focus the laser emission, and a controller configured to obtain print data from the printer and to operate the mount, the laser module, and the optic module to focus the laser emission only at the printed area of the substrate and not at the non-printed area of the substrate.

BRIEF DESCRIPTION OF THE SEVERAL VIEWS OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which:

FIG. 1 is a diagrammatic elevation view of the preferred embodiment of the present invention.

DETAILED DESCRIPTION OF THE INVENTION

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The system 20 of the preferred embodiment of the present invention is shown in FIG. 1. System 20 is mounted above a base 22 and downstream of a printer 24 and has a mount 26, a laser module 28, an optic module 30, a controller 32, a protective shroud 34, and a power supply 36.

Printer 24 uses liquid ink. In the preferred embodiment, printer 24 applies a voltage to a piezoelectric material in an ink-filled chamber behind a nozzle. Application of the voltage generates a pressure pulse in the liquid ink, forcing a droplet of ink through the nozzle, where the ink is applied to a substrate 40. In other embodiments, printer 24 applies liquid ink by other means. Printer 24 produces printed areas and non-printed areas. A printed area is any portion of the substrate to which ink has been applied. A non-printed area is any portion of the substrate to which ink has not been applied. In most print jobs, there will be numerous printed areas and numerous non-printed areas, but a print job could have but a single printed area or could have but a single non-printed area.

Base 22 is a means to move substrate 40 from printer 24 to the drying area of system 20. Base 22 is preferably a surface with rollers, a series of rollers, a belt conveyor, or a carriage. Substrate 40 preferably is paper or paperboard, but can also be plastic or other types of films.

Laser module 28 preferably comprises a laser that emits a narrow-band, low-divergence beam, preferably in the near-infrared region, most preferably 0.808 μm. In other embodiments, the laser of laser module 28 emits a narrow-band, low-divergence beam in the ultraviolet region. In yet other embodiments, laser module 28 is tunable and can emit radiation from ultraviolet to i infrared, preferably in bands of no more than 10 μm. In these embodiments, the emission of laser module 28 can be matched to the absorptive frequency of a chemical enhancer in the liquid ink.

In another embodiment, laser module 28 is a broad-band light source with filters, so that it emits a narrow-band, low divergence beam Laser module 28 in the preferred embodiment is attached to mount 26. Mount 26 is configured to hold laser module 28 over base 22 and to allow laser module 28 to slide laterally across base 22.

Laser module 28 is preferably surrounded by protective shroud 34. Shroud 34 acts as a safety cover, to keep a user's hands out of the mechanical and electromagnetic components of system 24, and as a laser light diffuser, to protect a user's eyes.

Optic module 30 is attached to laser module 28 and preferably comprises a focusing lens. Optic module 30 focuses the emission of laser module 28 onto printed material 40.

Controller 32 communicates with printer 24, laser module 28, and optic module 30. Preferably, controller 32 communicates wirelessly, but in other embodiments controller 32 communicates with the other components over hard-wire connections. Controller 32 is preferably an application-specific integrated circuit. In other embodiments, controller 32 is a microprocessor or a computer.

Data from printer 24 is received by controller 32. Controller 32 operates laser module 28 and optic module 30 to direct a narrow-band laser emission onto substrate 40. Because controller 32 receives the same print data as is received by the print head of printer 24, controller 32 directs laser module 28 and optic module 30 to apply the laser emission solely at the areas of substrate 40 on which printer 24 has applied liquid ink, and not to apply any radiation to areas of imprinted areas of substrate 40.

Power supply 36 is in electrical communication with laser module 28, mount 26, optic module 30, and controller 32, and supplies power to each of these components.

System 20 applies focused and intense radiation to the printed areas of substrate 40 to dry the liquid ink applied by printer 24. Because laser module 28 emits a low-divergence beam, system 20 can apply radiation to substrate 40 as finely as printer 24 applied liquid ink to substrate 20. As only the printed areas of substrate 40 are subjected to radiation, the loss of heat and energy is minimized. Because of the low thermal radiant loss, system 20 can be mounted in close proximity to printer 24, allowing for a tighter and more compact machine footprint and eliminating the need for a separate base 22 for a conventional dryer. The combination of system 20 with printer 24, then, provides a synergistic effect While preferred embodiments of the present invention are shown and described, it is envisioned that those skilled in the art may devise various modifications of the present invention without departing from the spirit and scope of the appended claims.

We claim:

1. A laser drying system for a printer, said system comprising:

a printer configured to apply liquid ink to a portion of a substrate to produce a printed area and a non-printed area;

a laser module comprising a laser emitting a laser emission, the laser module mounted on an adjustable mount and the laser emission being matched to the absorptive frequency of a chemical enhancer in the liquid ink;

a means to move the substrate from the printer to the laser module, the mount located over the means to move;

an optic module comprising a focusing lens to focus the laser emission; and a controller configured to obtain print data from the printer and to operate the mount, the laser module, and the optic module to focus the laser emission only at the printed area of the substrate and not at the non-printed area of the substrate.

2. The laser drying system of claim 1, wherein the laser emission is in the infrared region.

3. The laser drying system of claim 2, wherein the laser emission is approximately 0.808 μm.

4. The laser drying system of claim 1, wherein the laser emission is in the ultraviolet region.

5. The laser drying system of claim 1, wherein the laser module is tunable to emit from the ultraviolet to the infrared regions.

* * * * *